US008752638B2

(12) United States Patent
Nutley et al.

(10) Patent No.: US 8,752,638 B2
(45) **Date of Patent: *Jun. 17, 2014**

(54) DOWNHOLE APPARATUS WITH A SWELLABLE CENTRALISER

(75) Inventors: Kim Nutley, Inverurie (GB); Brian Nutley, Aberdeen (GB)

(73) Assignee: Swelltec Limited, Dyce, Aberdeen (GB)

( * ) Notice: Subject to any disclaimer, the term of this patent is extended or adjusted under 35 U.S.C. 154(b) by 548 days.

This patent is subject to a terminal disclaimer.

(21) Appl. No.: 12/470,386

(22) Filed: May 21, 2009

(65) Prior Publication Data

US 2009/0272525 A1 Nov. 5, 2009

Related U.S. Application Data

(63) Continuation of application No. PCT/GB2007/004443, filed on Nov. 21, 2007.

(30) Foreign Application Priority Data

Nov. 21, 2006 (GB) ..... 0623138.5
May 31, 2007 (GB) ..... 0710384.9

(51) Int. Cl.
*E21B 33/12* (2006.01)

(52) U.S. Cl.
USPC ..... 166/387; 166/191; 166/241.6

(58) Field of Classification Search
USPC ..... 166/387, 191, 241.6, 179, 213
See application file for complete search history.

(56) References Cited

U.S. PATENT DOCUMENTS 2,515,149 A * 7/1950 Willhoit ..... 166/241.6
3,578,084 A 5/1971 Bombardieri et al.
3,918,523 A 11/1975 Stuber
3,963,075 A 6/1976 Evans
4,137,970 A 2/1979 Laflin et al.
4,892,144 A 1/1990 Coone (Continued)

FOREIGN PATENT DOCUMENTS

CA 2565220 * 4/2008
EP 1437480 7/2004

(Continued)

OTHER PUBLICATIONS http://www.thefreedictionary.com/unitary.*

(Continued)

*Primary Examiner* — Sean Andrish
(74) *Attorney, Agent, or Firm* — Wong, Cabello, Lutsch, Rutherford & Brucculeri LLP

(57) ABSTRACT

A downhole apparatus, for example a centralizer, comprises a swellable material which expands upon contact with at least one predetermined fluid. In a first aspect of the invention, a centralizer comprises a body and a plurality of formations upstanding from the body. In another aspect, a downhole apparatus comprises a throughbore configured to receive a tubular, a swellable member, and a rigid assembly integrally formed with the swellable member. The rigid assembly provides stand off to the apparatus in use. In a further aspect, the downhole apparatus has a first condition before expansion of the swellable member in which a rigid assembly defines a maximum outer diameter of the apparatus. In a second condition after expansion of the swellable member, the swellable member defines a maximum outer diameter of the apparatus. In a preferred embodiment, the rigid assembly is designed to flex or deform under an axial or radial load.

8 Claims, 13 Drawing Sheets

(56) References Cited

U.S. PATENT DOCUMENTS

| | | | | |
|---|---|---|---|---|
| 5,027,894 | A | 7/1991 | Coone | |
| 5,810,100 | A | 9/1998 | Samford | |
| 6,032,748 | A | 3/2000 | DeBray et al. | |
| 6,581,682 | B1 | 6/2003 | Parent et al. | |
| 7,431,098 | B2 | 10/2008 | Ohmer et al. | |
| 7,604,059 | B2 | 10/2009 | Thornton | |
| 7,699,111 | B2 | 4/2010 | Brooks et al. | |
| 7,784,550 | B2 | 8/2010 | Nutley et al. | |
| 7,896,085 | B2 | 3/2011 | Nutley et al. | |
| 8,191,643 | B2 * | 6/2012 | Nutley et al. | 166/387 |
| 2004/0055758 | A1 | 3/2004 | Brezinski et al. | |
| 2004/0112609 | A1 | 6/2004 | Whanger et al. | |
| 2005/0110217 | A1 | 5/2005 | Wood et al. | |
| 2006/0042801 | A1 | 3/2006 | Hackworth et al. | |
| 2006/0124310 | A1 | 6/2006 | Lopez de Cardenas et al. | |
| 2006/0175065 | A1 | 8/2006 | Ross | |
| 2006/0260820 | A1 * | 11/2006 | Whitsitt et al. | 166/387 |
| 2007/0144733 | A1 | 6/2007 | Murray et al. | |
| 2007/0246213 | A1 | 10/2007 | Hailey, Jr. | |
| 2007/0246225 | A1 | 10/2007 | Hailey, Jr. et al. | |
| 2008/0110626 | A1 | 5/2008 | Allison et al. | |
| 2009/0139707 | A1 | 6/2009 | Berzin et al. | |
| 2009/0179383 | A1 | 7/2009 | Koloy et al. | |
| 2009/0272546 | A1 | 11/2009 | Nutley et al. | |
| 2010/0051294 | A1 | 3/2010 | Nutley et al. | |
| 2010/0051295 | A1 | 3/2010 | Courville et al. | |

FOREIGN PATENT DOCUMENTS

| | | | |
|---|---|---|---|
| GB | 2201176 | | 5/1988 |
| GB | 2411918 | | 11/2006 |
| GB | 2416796 | B | 2/2007 |
| GB | 2447996 | | 1/2010 |
| GB | 2453474 | | 8/2010 |
| GB | 2449008 | | 3/2011 |
| GB | 2468606 | | 3/2011 |
| WO | 99049180 | | 9/1999 |
| WO | 0220941 | | 3/2002 |
| WO | 2005052308 | | 6/2005 |
| WO | 2006053896 | A1 | 5/2006 |
| WO | 2006121340 | A1 | 11/2006 |

OTHER PUBLICATIONS http://www.thefreedictionary.com/solid.* http://education.yahoo.com/reference/dictionary/entry/plate.* http://www.thefreedictionary.com/Circumferentially.* http://dictionary.reference.com/browse/finger.* http://www.thefreedictionary.com/unitary; date unknown. SA Feb. 6, 2014.* http://www.thefreedictionary.com/solid ; date unknown. SA Feb. 6, 2014.* http://education.yahoo.com/reference/dictionary/entry/plate; date unknown. SA Feb. 6, 2014.* http://www.thefreedictionary.com/Circumferentially; date unkown. SA Feb. 6, 2014.* http://dictionary.reference.com/browse/finger; date unkown. SA Feb. 6, 2014.*

International Written Opinion and Search Report regarding corresponding application No. PCT/GB2007/004443, dated Apr. 4, 2008.

International Written Opinion and Search Report regarding international application No. PCT/GB2007/004454, dated Mar. 18, 2008.

International Written Opinion and Search Report regarding corresponding application No. PCT/GB2007/004445, dated Mar. 14, 2008.

International Written Opinion and Search Report regarding corresponding application No. PCT/GB2007/004453, dated Mar. 18, 2008.

* cited by examiner

DOWNHOLE APPARATUS WITH A SWELLABLE CENTRALISER

CROSS-REFERENCE TO RELATED APPLICATIONS

This application claims priority to PCT application PCT/GB2007/004443, filed Nov. 21, 2007, which in turn claims priority to United Kingdom Patent Application No. GB0623138.5, filed on Nov. 21, 2006 and United Kingdom Patent Application No. GB0710384.9, filed on May 31, 2007.

FIELD OF THE INVENTION

The present invention relates to downhole apparatus for use in hydrocarbon wellbores. In its various aspects, the invention relates to a downhole apparatus, a method of use, and a kit of parts for forming the downhole apparatus. In particular, the invention relates to an apparatus for use in applications relating to the centralisation of downhole tubulars and components.

BACKGROUND

Centralisers perform important functions in wellbore operations. Centralisers may be used, for example, to ensure that a tubular or a portion of a tubular does not come into contact with a wellbore surface. This provides protection for the tubular against wear due to friction or impact with the borehole during run-in. A centraliser may be positioned on a tool string or completion string to provide stand-off protection to part of the string that is particularly sensitive to wear, friction or impact with the bore wall. This includes tool joints, sandscreens, and flow control devices.

Centralisers also have an important function in cementing applications. A poorly centralised tubular can lead to a poor fluid sweep of drill cuttings prior to cementing and the failure to form a cement bond around the entire circumference of the annular space between the tubular and the wellbore. This can result in poor isolation of well fluids, which can ultimately lead to uncontrollable flow of well fluids to the surface or to subterranean geological formations.

Centralisers are provided with blades or other formations to create stand-off from the body, to provide a large flow bypass area, and to assist with creating a turbulent flow of mud and cement. However, micro-channels may still be formed between the cement and the bore wall and/or between the outer surface of the centraliser body or blades and the bore wall.

A well packer provides a seal in an annulus formed between an exterior surface of a tubular and an interior surface of well casing or a wellbore. Known forms of well packers are introduced in an unexpanded condition to the downhole environment in which they are to be used and expanded in-situ to provide the desired seal. In one form, the well packer expands upon coming into contact with a well fluid. In another form, the well packer comprises movable parts that are actuated in-situ to form the seal.

The integrity of the annular seal created by a well packer is paramount. It is advantageous for the tubular on which the packer is located to be centrally located in the bore, such that, when the packer is expanded, it exerts a force against the bore that is substantially uniformly distributed around the circumference. If the tubular is positioned to one side of the bore, which is typically true for an inclined bore, the expansion force of the packer will have to act against the side load weight of the tubular to move to its expanded condition. If the expansion force is insufficient to overcome the side load weight, the packer may seal asymmetrically in the bore, with the packer having a radially short side (on the low side of the bore) and a radially longer side (on the high side of the bore). This results in a potential failure mode between the packer and the bore wall on the high side of the bore.

SUMMARY

It is amongst the aims of an aspect of the invention to provide an apparatus and method which overcomes or mitigates one or more of the deficiencies or drawbacks of the prior art. It is a further aim of an aspect of the invention to provide an improved centraliser for use in a variety of downhole applications. It is another aim of an aspect of the invention to provide an apparatus offering improved centralisation for well packers and other isolation tools. Additional aims and objects of the invention will become apparent from the following description.

According to a first aspect of the invention, there is provided a centraliser for a downhole tubular, the centraliser comprising a body and a plurality of irregularities or formations upstanding from the body, wherein the centraliser comprises a swellable material selected to expand on exposure to at least one predetermined fluid. Preferably, the swellable material is selected to expand on exposure to a hydrocarbon fluid. The centraliser therefore is capable of sealing micro-channels in the annular space, preventing the further flow of hydrocarbons.

The centraliser may comprise a rigid assembly or support assembly and a swellable member. The rigid assembly functions to support and protect the swellable member, and is relatively rigid with respect to the swellable member. However, the rigid assembly may be designed to flex or deform under an axial or radial load, and thus should not be considered as absolutely rigid. In particular, the rigid assembly may provide rigidity to the apparatus during an assembly of the apparatus on a tubular, which may be by slipping the apparatus onto a tubular. The rigid assembly may resist torsional deformation of the apparatus, which, for example, it may be exposed to on assembly and/or run in. The rigid assembly may resist bending of the apparatus. The rigid assembly of the invention may otherwise be defined as a "support assembly," and references to one term should be considered to encapsulate the other. The rigid assembly may also define the formations of the centraliser.

When the centraliser is in use downhole in the first condition, the rigid assembly or support assembly can provide stand-off protection for the swellable member. That is, the swellable member is supported by the rigid assembly away from the borehole wall or lined borehole. The rigid assembly may also provide stand-off protection for the tubular and for any components of the tubular adjacent or close to the apparatus.

The maximum outer diameter defined by the rigid assembly may be selected to be not less than the drift diameter of a borehole in which the apparatus is located. The maximum outer diameter defined by the rigid assembly may be selected to be gauge, or substantially gauge with a borehole in which the apparatus is located. Alternatively, the maximum outer diameter defined by the rigid assembly may be selected to be greater than the borehole diameter. In this scenario, maximum outer diameter defined by the rigid assembly may be slightly larger than the borehole diameter such that the apparatus may still be run in the borehole, with a radial force from the borehole wall acting to exert a compressive radial force on the apparatus.

The swellable member may be expanded to a maximum outer diameter greater than or equal to the maximum outer diameter defined by the rigid assembly. The swellable member may be expanded to, for example, provide isolation. The swellable member may be expanded to provide a fluid seal, or, alternatively, may be expanded to prevent or restrict the flow of solid particles, for example, cuttings or produced sands in the annulus outside of the tubular.

The centraliser may be configured such that a part of the rigid assembly is surrounded by the swellable member. The rigid assembly may extend into the swellable member. The swellable member and the rigid assembly may have an integral construction to together form the centraliser. The swellable member may be disposed between the rigid assembly and a tubular on which the downhole apparatus is located in use. The rigid assembly may comprise at least one collar surrounded by the swellable member. More specifically, the at least one collar may be proximal to a bore defined by the swellable member and extending through the centraliser.

Alternatively or in addition, the rigid assembly may comprise two collars spaced apart from each other in a longitudinal direction of the centraliser.

Alternatively or in addition, the rigid assembly may comprise a plurality of spaced apart fingers. More specifically, each of the plurality of spaced apart fingers may extend in a longitudinal direction. Alternatively or in addition, the fingers may be spaced apart radially around the downhole apparatus.

Alternatively or in addition, the plurality of fingers may be attached to a collar towards each opposing end of the downhole apparatus.

Alternatively or in addition, the at least one collar and the plurality of fingers may be integrally formed with each other. Preferably, at least one collar and the plurality of fingers are of unitary construction.

The rigid assembly may comprise one or more bows, and may therefore resemble a bow spring centraliser. Accordingly, the rigid assembly may be designed to flex or deform under an axial or radial load. This permits obstacles, washouts, or regions of reduced diameter to be negotiated during run in of the tubular. The apparatus may be configured to support the side load weight of the tubular to provide centralisation, even in inclined or horizontal wells.

In an alternative embodiment, the rigid assembly may comprise a rigid member extending radially from the apparatus in its first condition. The rigid assembly may comprise one or more members or blocks located in the apparatus. The members or blocks may be embedded into or partially encapsulated by the swellable member.

Alternatively or in addition, the rigid assembly may be formed at least in part of at least one of: a metal, a composite, a plastic, or the like. The rigid assembly preferably comprises a material which is harder and/or wear resistant relative to the material of the swellable member.

The centraliser may further comprise a support structure configured to act against axial and/or shear forces experienced by the centraliser. More preferably, the support structure is configured to reduce extrusion of the radially expanding member due to axial and/or shear forces. The support structure may be configured to be further deployed by axial and/or shear forces experienced by the centraliser.

The support structure may comprise an attachment means for coupling to the apparatus and a support portion, wherein the support structure has a first unexpanded condition and a second expanded condition, and is configured to be deployed to its second expanded condition by expansion of the swellable member.

The support structure may be configured to abut against a surface of the swellable member before and during expansion of the swellable member. The support structure may also be configured to abut against a portion of the surface of the radially expanding member. Preferably, the support structure is arranged to at least partially surround an end of the radially expanding member. The support structure may substantially cover an end of the radially expanding member. The support structure may extend along a part of a length of the radially expanding member.

Alternatively or in addition, the support structure may comprise a plurality of rigid support members that are configured for movement in relation to each other to accommodate expansion of the radially expanding member.

The centraliser may be adapted to rotate on a tubular in a downhole environment. The centraliser may be adapted to rotate on the tubular during run in, when the centraliser is in an unexpanded condition.

The swellable member may define at least one irregularity. More specifically, the at least one irregularity may comprise at least one of: a groove, a ridge, an indentation, a protuberance, a roughened area and an aperture to a bore, which extend into the swellable member. Alternatively or in addition, the at least one irregularity may extend substantially longitudinally along the swellable member. For example, where the irregularity is a channel, the channel may extend longitudinally along the swellable member.

The irregularity may be arranged to define a flow path for fluid passing the centraliser. The irregularity may be arranged to induce or create a turbulent flow. The irregularity may be arranged to create a turbulent flow in drilling fluid or mud flowing past the centraliser, or may be arranged to create a turbulent flow in cement flowing past the centraliser.

The swellable member may have a first mating profile towards a first end, and the apparatus may further comprise a connector having a mating profile configured to mate with the first mating profile of the swellable member.

The swellable member may comprise a second mating profile towards a second, opposing end. The second mating profile may be identical to the first, and the connector may be connected to either of the first and second ends of the swellable member.

The connector may be adapted to permit rotation of the centraliser on a tubular. The connector may comprise a mating portion, which may be adapted to rotate on a tubular. The connector may further comprise a retaining portion, adapted to prevent or limit axial movement of the centraliser and/or the connector on a tubular. The mating portion and/or the retaining portion may comprise a bearing surface.

Alternatively or in addition, the apparatus may be attached to the tubular, e.g., by means of an adhesive or bonding agent.

The centraliser may be a casing centraliser. The centraliser may be configured to support the side load weight of the tubular to provide centralisation, even in inclined or horizontal wells. The centraliser as may be a solid body centraliser, and the swellable material may form a part of the body of the centraliser.

The centraliser may be a casing centraliser. The centraliser may be configured to support the side load weight of the tubular to provide centralisation, even in inclined or horizontal wells. The centraliser may be a solid body centraliser, and the swellable material may form a part of the body of the centraliser.

In one embodiment, the formations are blades, which may be helically oriented on the body. The blades may comprise a swellable material selected to expand on exposure to a hydrocarbon fluid. The swellable material may form a swellable member configured to expand to an inner diameter of a wellbore in which the centraliser is located in use.

According to a second aspect of the invention, there is provided a method of constructing a wellbore, the method comprising the steps of: running a tubular and a centraliser to a downhole location, the centraliser comprising a swellable material selected to expand on exposure to at least one predetermined fluid; and cementing the tubular and centraliser in the downhole location. Further embodiments of the second aspect of the present invention may comprise or utilise one or more features according to the first aspect of the present invention.

According to a third aspect of the present invention, there is provided a downhole apparatus for location on a tubular in a downhole environment, the downhole apparatus comprising: a throughbore configured to receive a tubular; a swellable member which expands upon contact with at least one predetermined fluid; and a rigid assembly integrally formed with the swellable member and which provides stand-off to the apparatus in use.

According to a fourth aspect of the present invention, there is provided downhole apparatus configured to be disposed on a tubular in a downhole environment, the downhole apparatus comprising: a swellable member which expands upon contact with at least one predetermined fluid; and a rigid assembly, the downhole apparatus having a first condition before expansion of the swellable member, in which the rigid assembly defines a maximum outer diameter of the downhole apparatus, and a second condition after expansion of the swellable member, in which the swellable member defines a maximum outer diameter of the downhole apparatus.

Embodiments of the third or fourth aspects of the invention may comprise one or more features of the first aspect of the invention or its embodiments. In particular, the rigid assembly and/or swellable member of the third or fourth aspects of the invention may comprise the rigid assembly and/or swellable member of the first aspect of invention.

According to a fifth aspect of the invention there is provided a kit of parts which, when assembled together forms a downhole assembly, the kit of parts comprising the apparatus of the third or fourth aspects of the invention and a connector. The connector may be that defined with reference to embodiments of the third aspect of the invention.

According to a sixth aspect of the invention there is provided a centraliser and a well packer comprising the apparatus of the third or fourth aspect of the invention.

According to a seventh aspect of the invention, there is provided logging tool comprising the apparatus of the third or fourth aspect of the invention. Preferably, the rigid assembly provides protection for an instrument of the logging tool.

DETAILED DESCRIPTION

Figure 1A:
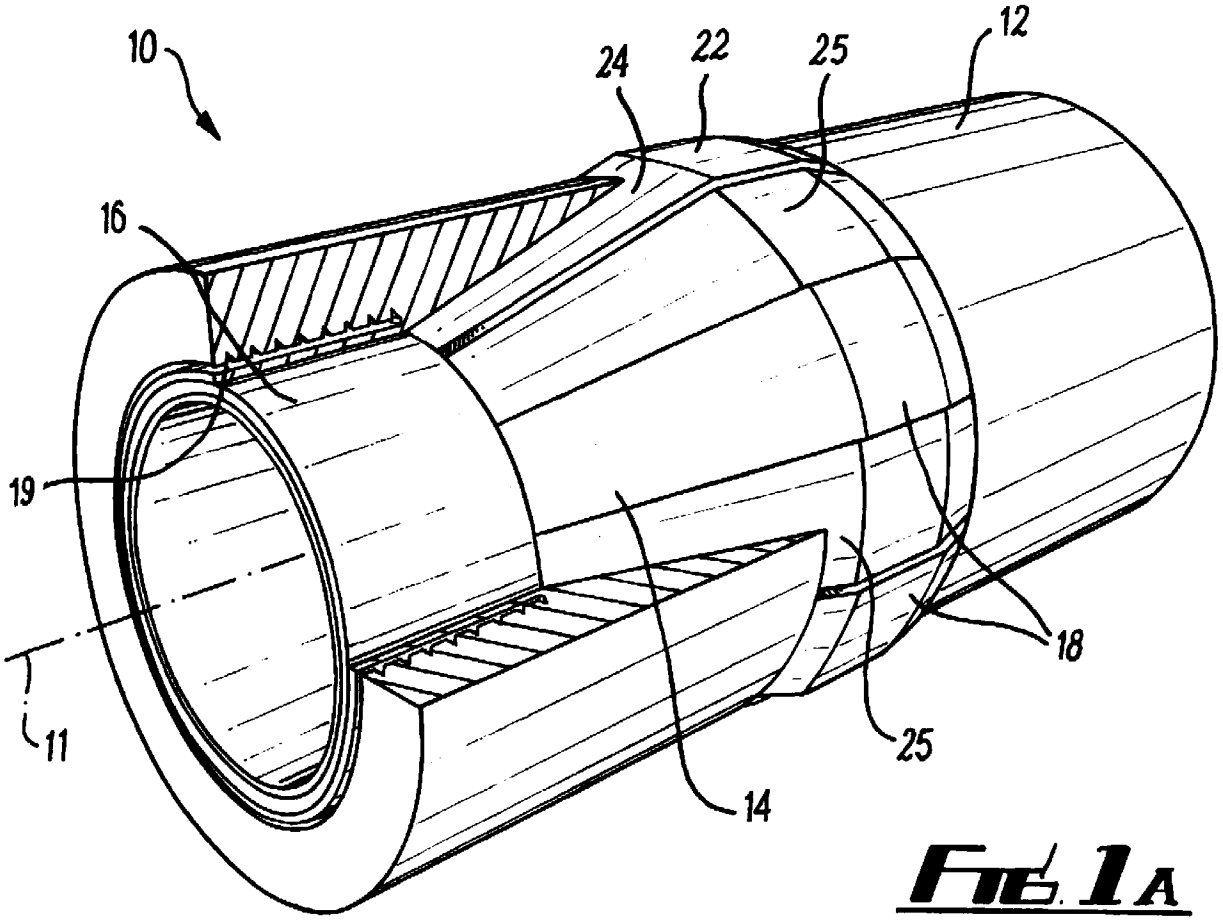
FIG. 1A is a perspective, partially cut away view of a downhole apparatus in accordance with a first embodiment of the invention.
Figure 1B:
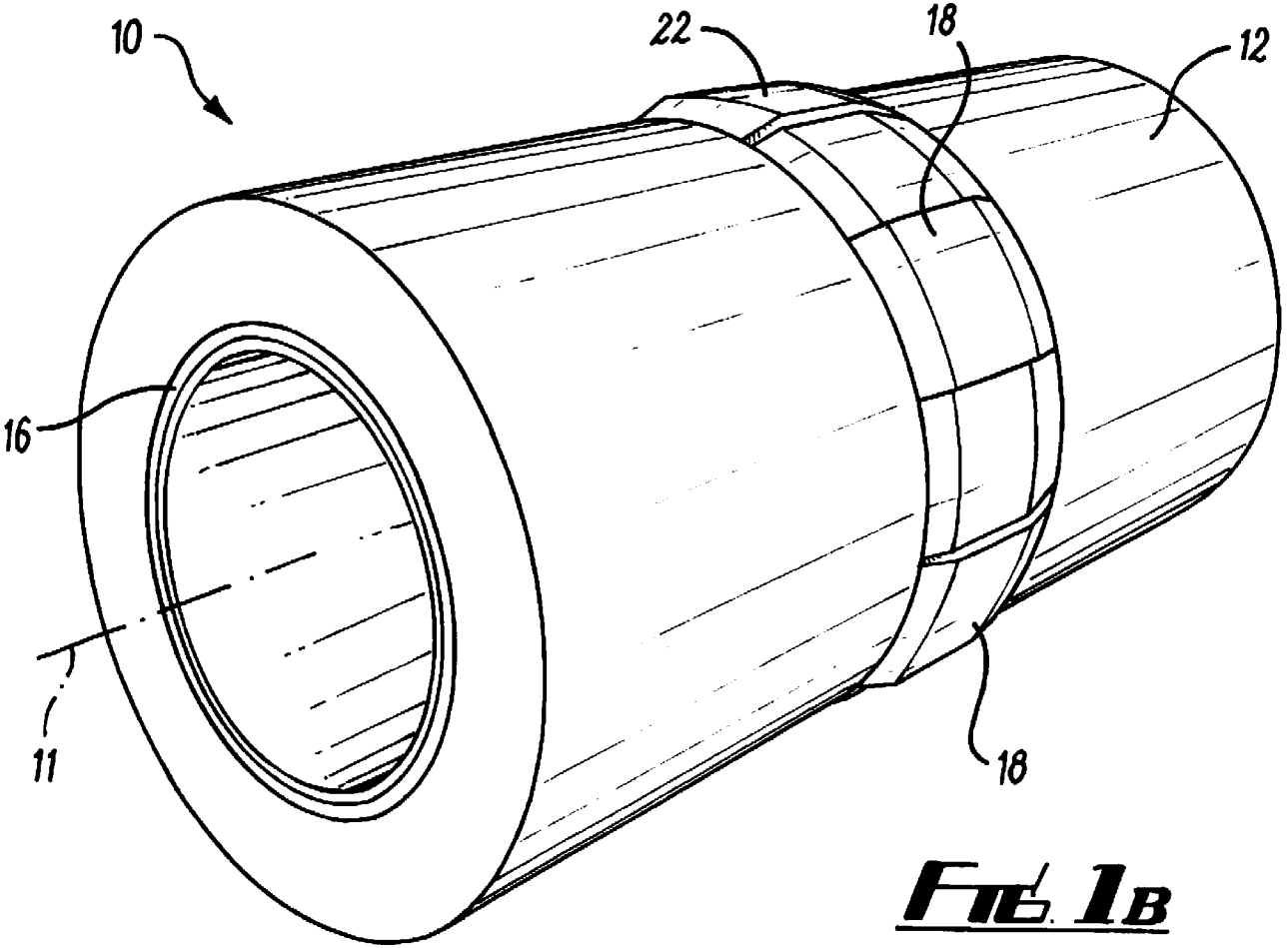
FIG. 1B is a perspective, outer view of the downhole apparatus of FIG. 1A.
Figure 1C:
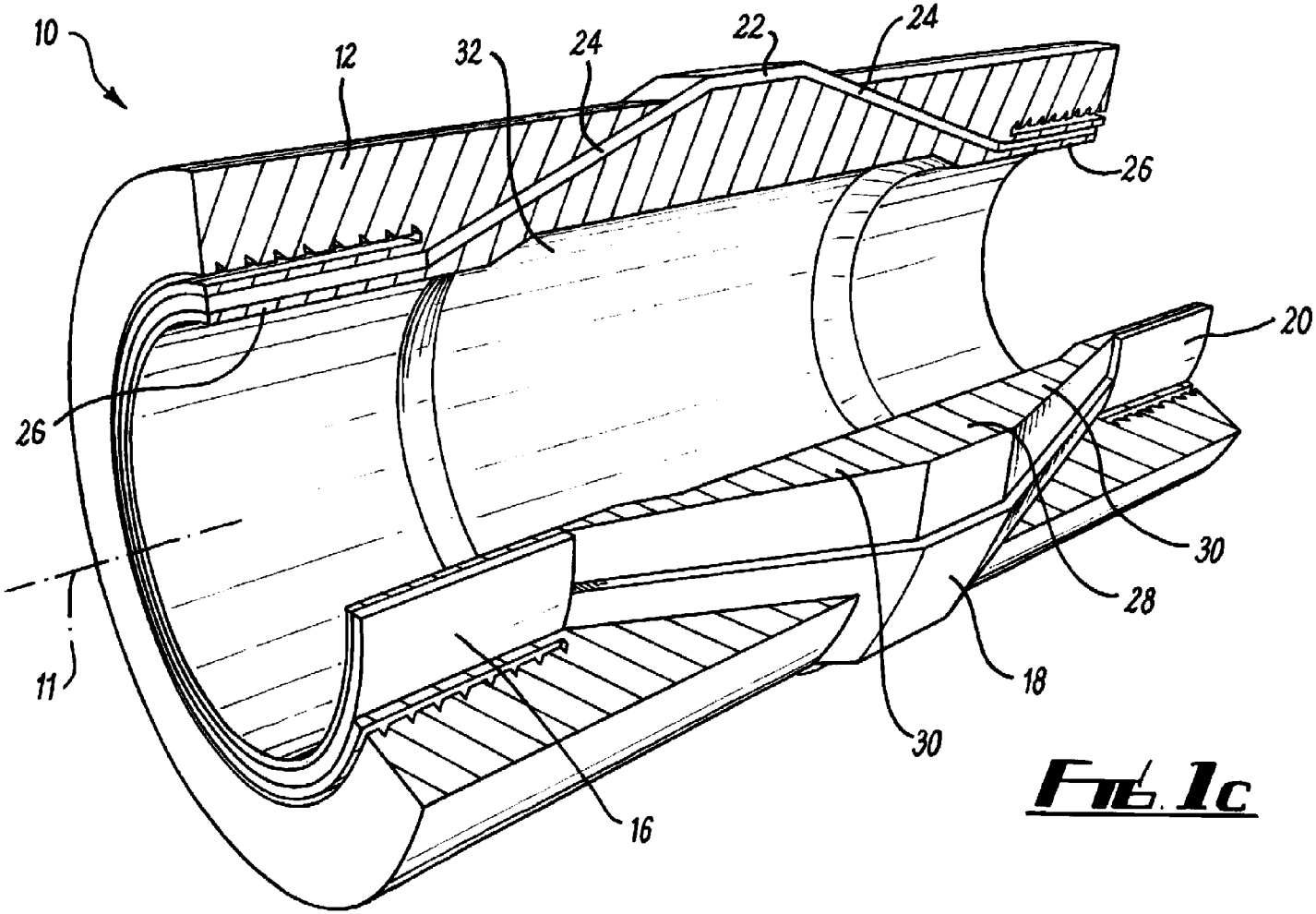
FIG. 1C is an alternative perspective, partially cut-away view of the downhole apparatus of FIG. 1A.
Figure 2:
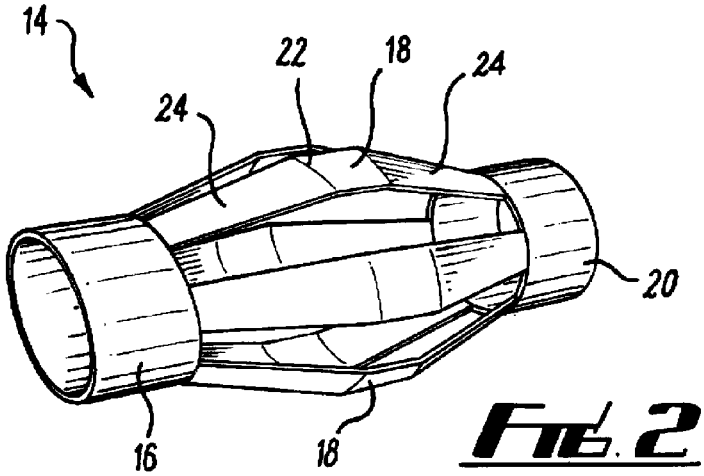
FIG. 2 is a perspective view of a rigid assembly forming part the downhole apparatus of FIG. 1.

Referring firstly to FIGS. 1 and 2, there is shown generally at 10 a downhole apparatus in accordance with a first embodiment of the present invention. The apparatus comprises a swellable member 12 and a rigid assembly 14. The apparatus 10 comprises a throughbore 11 which is sized such that the apparatus can be slipped onto a tubular on which it is being used. The downhole apparatus is rotatably mounted on the tubular in this embodiment.

The rigid assembly 14, shown in isolation in FIG. 2, has three parts: a first collar 16, a plurality of spaced apart fingers 18 and a second collar 20. The first collar 16 and second collar 20 are located within the body of the swellable member 12. The first collar 16 and second collar 20 are located towards opposing ends of the swellable member 12 and are joined by the plurality of spaced apart fingers 18. The fingers 18 are spaced apart around the circumference of the swellable member 12 such that apertures 25 are present between the fingers. Note that the second collar 20 is not shown in FIG. 1, because FIG. 1 shows the swellable member cut away in the vicinity of the first collar 16 but not cut away in the vicinity of the second collar 20.

Each of the fingers 18 comprises an outer portion 22 which defines the outer diameter of the assembly 14 and the outer diameter of the apparatus in the configuration shown most clearly in FIG. 1B. The fingers 18 follow a path such that the outer portion 22 defines the maximum outer diameter of the assembly at the mid-point of the fingers 18. Two transitional portions 24 join the outer portions 22 to the collars 16, 20. In this embodiment, the outer portion 22 defines a part-cylindrical surface concentric with the collars, but in other embodiments the fingers may define a smooth arcuate path and the outer portion may be curved in the axial direction.

The two collars and the plurality of fingers are integrally formed with one another of a suitable rigid material, such as a metal. The rigid assembly is similar in form and function to a bow spring centraliser, and is designed such that the spaced apart fingers 18 of the rigid assembly 14 can resiliently flex when exposed to radial and/or axial loads. For example, when a radial load is experienced by the outer portion 22, the outer diameter defined by the rigid assembly 14 reduces, and the axial length of the rigid assembly increases correspondingly. This assists with shock resistance and negotiation of obstacles in the bore during run in.

In another embodiment (not illustrated), the rigid assembly is of unitary construction and is formed as a body of a metal such as steel. The body is formed from a flat sheet of metal, from which the apertures 25 are laser cut. The flat sheet is deformed to create a linear series of fingers, the sheet is wrapped around a cylindrical mandrel, and the two opposing edges of the sheet are welded together to create a substantially cylindrical body.

Each end of the swellable member defines a recess 19 having ridges to allow for push fit connection with a connector (not shown) to enable the apparatus to be used as part of a modular system or kit of parts. This will be described in more detail below.

As shown most clearly in FIG. 1C, the swellable member is formed around the rigid assembly such that the majority of the rigid assembly is encased by the swellable member. The swellable member is therefore disposed between the rigid assembly and the bore in which the apparatus is located. The swellable member is also formed on the interior of the rigid assembly, such that it is disposed between the rigid assembly and a tubular on which the apparatus is located. Radially inward of the collars 16, 20 are located cylindrical portions 26 of the swellable material which lie between the collars and the tubular in use. Radially inward of the fingers 18 is a portion of the swellable member which is profiled to fill the space beneath the fingers, and as such comprises an outer cylindrical portion 28 and transitional portions 30. In the spaces between the fingers 18, the swellable member is continuous from the space defined by the rigid assembly to the outer surface of the swellable member.

The inner surface of the swellable member 12 is profiled such that it has a portion 32 of increased inner diameter relative to the portions 26 of the swellable member disposed inward of the collars 16, 20. This introduces a small amount of flexibility into the swellable member which may be desirable for assembly, and also may account for inward swelling experienced by this part of the swellable member resulting from the greater thickness of swellable material.

The swellable member 12 is formed as a single moulded piece around the rigid assembly 14 from a material selected to expand upon exposure to a predetermined fluid. The swellable member may be compression moulded or injection moulded. Such swellable materials are known in the art. In this example, the swellable member is required to swell in oil, and the material comprises ethylene propylene diene monomer rubber (EPDM). In an alternative embodiment, where the swellable member is required to swell in water, the material comprises any lightly crosslinked hydrophilic polymer embedded within the main swellable member elastomer, such as at least one of chloroprene, styrene butadiene or ethylene-propylene rubbers. Such water-absorbing resins are termed "superabsorbent polymers" or "SAPs" and when embedded within the swellable member may expand when in contact with an aqueous solution. In a further alternative embodiment, the swellable member comprises an ethylene-propylene-diene polymer with embedded water absorbent resin such that expansion of the swellable member results from contacting either an aqueous solution or polar liquid such as oil or a mixture of both.

In use, downhole apparatus of FIG. 1 is introduced downhole in a first condition before expansion of the swellable member. As shown in FIG. 1, the rigid assembly 14 defines a maximum outer diameter of the downhole apparatus such that it provides, for example, a stand-off or stabilising function. The rigid nature of the rigid assembly 14 provides protection for the downhole apparatus and supports the weight of the tool string while it is being run. This reduces friction during run in and provides protection of the tubular against wear and impact. This may be particularly desirable in applications to the running of relatively low wear-resistant components such as sandscreens.

Figure 3:
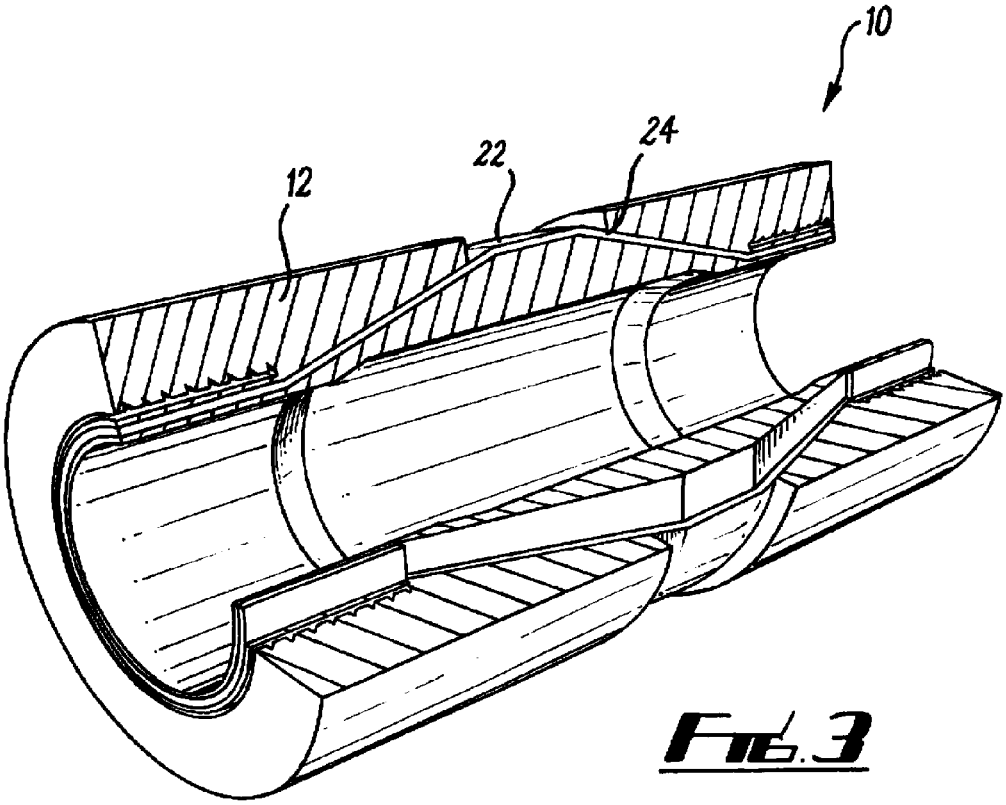
FIG. 3 is a perspective, partially cut-away view of the downhole apparatus of FIGS. 1 and 2 in an expanded condition.

Also, the structure of the rigid assembly 14, which extends into the body of the swellable member, functions as a skeleton to moderate the effect of shear forces that would, were it not for the rigid assembly 14, be exerted in an uncontrolled manner on the swellable member. The spaced apart fingers 18 of the rigid assembly 14 can flex such that the maximum outer diameter defined by the rigid assembly 14 reduces. This allows the downhole apparatus 10 to pass through restrictions. When the downhole apparatus is in the desired location (e.g. where it is desired to create a seal) the swellable member is exposed to the predetermined fluid. The swellable member then expands such that it defines the maximum outer diameter of the downhole apparatus, as shown in FIG. 3.

The apparatus may therefore be used to provide isolation in a wellbore. The use of a swellable material to provide isolation is particularly useful in sandy formations in which the sandface may be damaged by forces exerted by other classes of isolation tool. The apparatus therefore has particular benefit when being run adjacent to a sandscreen into a sand formation. The apparatus provides stand-off protection for the sandscreen, and is subsequently expanded to provide isolation which prevents produced sands from flowing in the annulus, in a manner that does not damage the sandface.

The stand-off provided by the rigid assembly has the important benefit of avoiding restriction to the expansion of the swellable member upon exposure to the predetermined fluid. An annular space between the outer surface of the swellable member and the inner surface of the bore in which the apparatus is located allows uniform expansion of the swellable member. The uniform swelling creates a substantially uniform sealing force against the inner surface of the bore, which reduces the potential for a failure mode in the annular seal. This is particularly useful where the swelling force capable of being exerted by the swellable member is insufficient to overcome a side load weight of the tubular. In such circumstances, if no centralisation is provided, there would be a significantly larger degree of expansion on the high side of the tubular compared with the expansion on the low side.

Figure 4A:
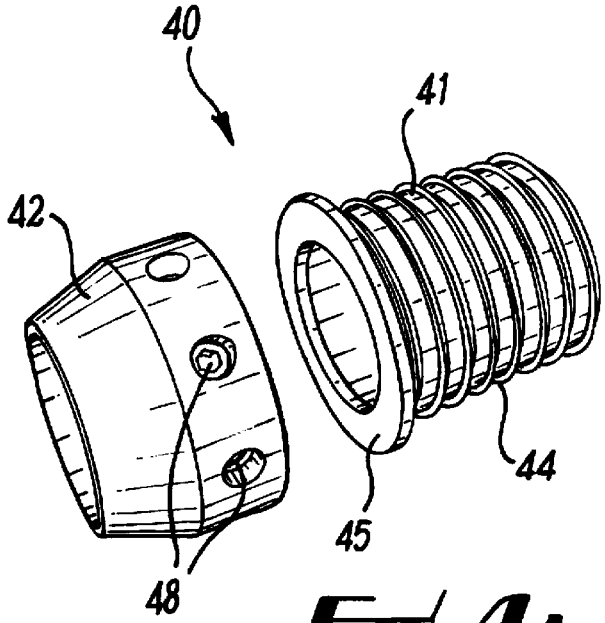
FIG. 4A is a perspective view of an end connector assembly which may be used with one embodiment of the invention.
Figure 4B:
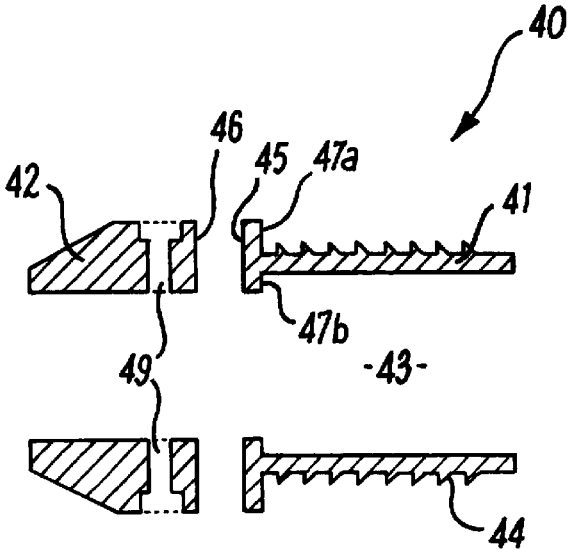
FIG. 4B is a longitudinal section through the end connector assembly of FIG. 4B.

The recess 19 shown in FIG. 1 allows the apparatus to be used as a modular system of downhole components and/or supplied as a kit of parts. The recess 19 has a ridged profile, arranged to form a mating profile with a connector which is received in the recess such that the connector is sandwiched between portions of the swellable member. The connector may be an end connector, such as that shown generally at 40 in FIGS. 4A and 4B.

The end connector 40 comprises two components: a mating portion 41 and a retaining portion 42. The mating portion 41 is of a generally cylindrical shape, such that it defines a bore 43. A ridged profile 44 is provided towards one end of the mating portion 41, which corresponds to the mating profile in the recess 19. The opposing end of the mating portion provides a bearing surface 45, which abuts a corresponding bearing surface 46 of the retaining portion 42. Lips 47*a*, 47*b* are formed on the external and internal surfaces of the mating portion 41 respectively. Lip 47*a* defines a radially extending surface, which constrains the expansion of the swellable member in the axial direction. Lip 47*b* defines an enlarged bore for receiving the inner parts of the swellable member and rigid assembly. The retaining portion 42 also has fixing means in the form of bolts 48 that engage via threading with bores 49 at locations spaced apart circumferentially around the external surface of the retaining portion. The bolts can be used to attach the end connector 40 to a downhole component, such as a casing section. When used with the end connector 40, the apparatus will be rotatable on the tubular. The mating portion 41 is coupled to the apparatus and rotates with the apparatus, and relative to the retaining portion 42. The retaining portion 42 prevents axial movement of the apparatus. In another embodiment (not illustrated), an end connector may be used which is similar to the end connector 40, except that the mating portion and retaining portion are integrally formed or of unitary construction to prevent the mating portion 41 and apparatus from rotating on the tubular.

Figure 5:
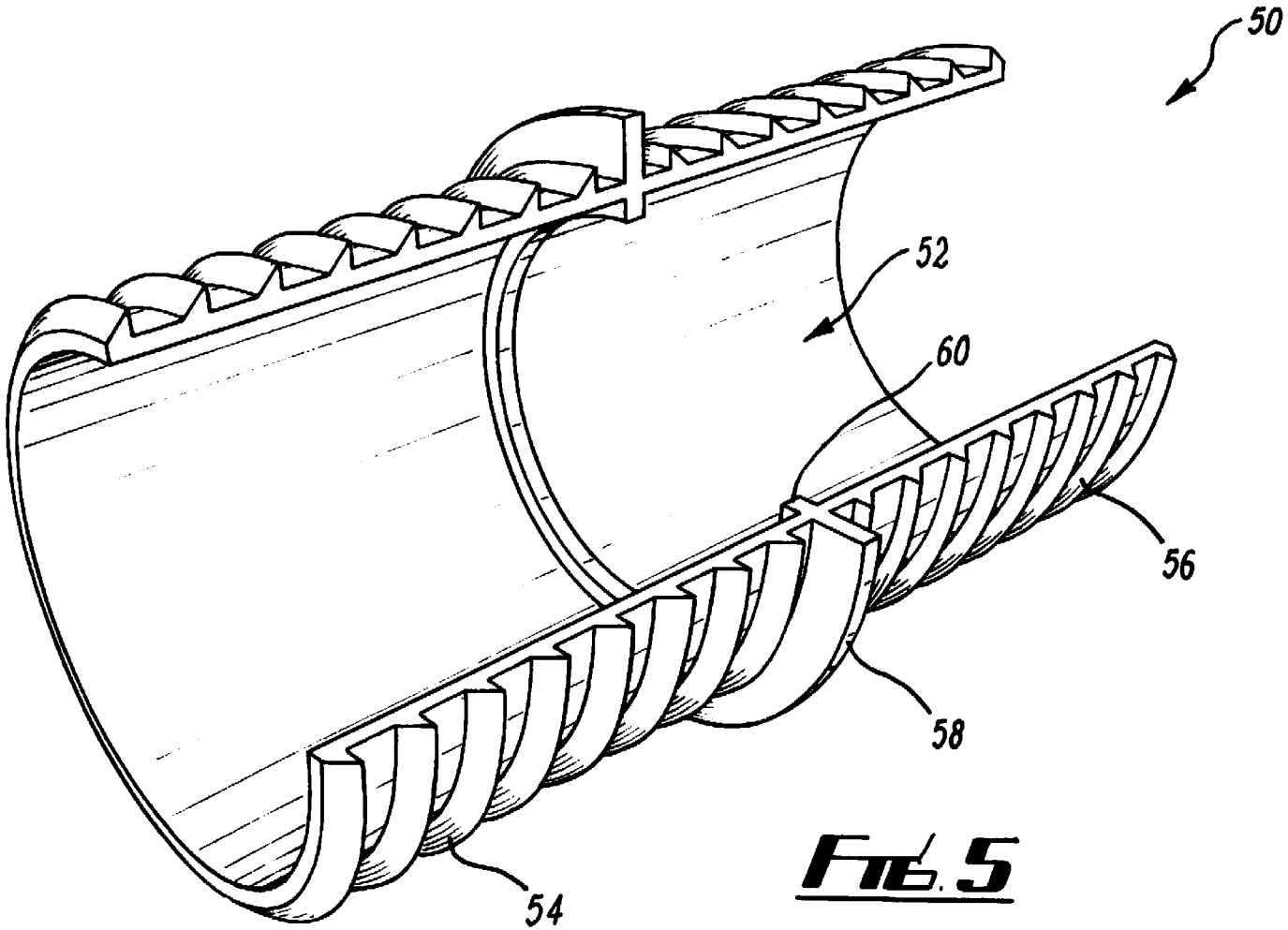
FIG. 5 is a perspective view of an alternative connector which may be used with the apparatus of FIGS. 1A to 1C.

Alternatively, the connector may be of the type shown generally at 50 in FIG. 5. This connector 50 is arranged to facilitate connection of the apparatus 10 to a further swellable member such as a packer. The connector 50 is of generally cylindrical shape such that it defines a bore 52. The connector has first and second ridged profiles 54, 56 towards respective opposing ends of the connector, as described above. First 58 and second 60 flanges (which constitute arresting members) are provided on the connector 50. The first flange 58 extends radially from the external surface of the connector, i.e., in a direction away from a tubular on which an assembled kit of parts is installed. The second flange 60 extends radially into the bore 52 of the connector. The first and second flanges constrain the expansion of the swellable member as described above.

The use of the connector 50 allows the apparatus to be used as kit of parts that can be assembled in the field to meet a particular specification. For example, a series of kits of parts according to the invention can be connected together to provide a string of swellable members where packer coverage of a long length of tubular is required.

The above-described embodiment of the invention is manufactured to be gauge with many common bore diameters, thereby providing maximum stand off. The inclusion of a swellable elastomer means that the invention benefits from the integral construction of swellable member and rigid assembly that is robust and high in impact strength. Once wetted with well fluids, the swellable elastomer member allows improved running of well tubulars due to a lower frictional coefficient. This is of benefit in highly deviated wells or extended reach horizontal wells where cumulative resistive drag can prohibit the full installation of metal tubulars.

There will now be described a support structure which may be used in conjunction with the apparatus 10 of FIG. 1, or may indeed be used with alternative expanding apparatus such as well packers.

Figure 6B:
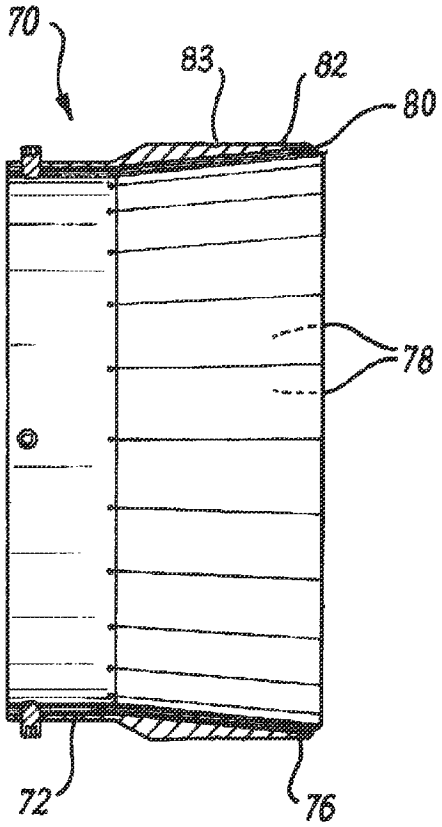
FIGS. 6A and 6B are, respectively, perspective and part-sectional views of a support structure which may be used with the apparatus of FIGS. 1A to 1C, in accordance with an embodiment of the invention.
Figure 6A:
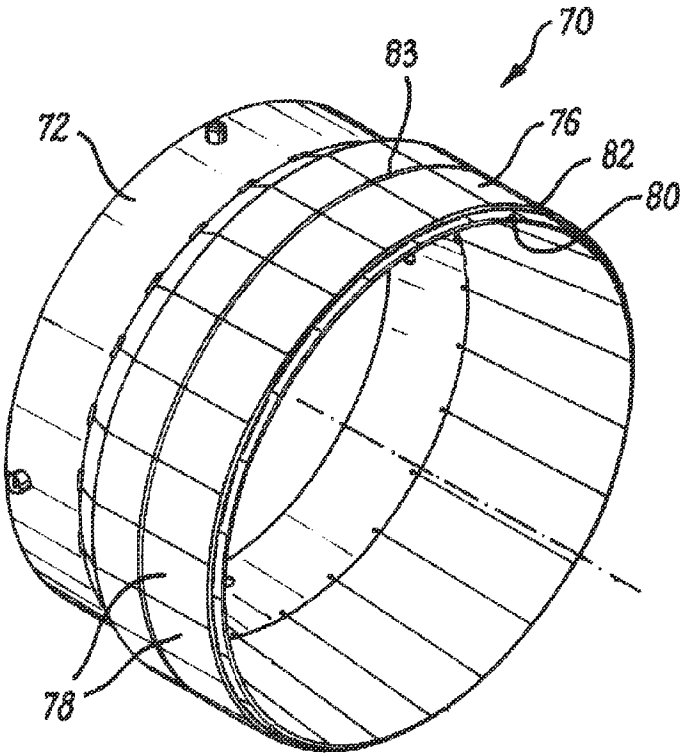

According to FIGS. 6A and 6B, there is shown, respectively, in perspective and side views, a support structure, generally shown at 70. The support structure 70 is formed from metal such as steel. The support structure 70 is configured to abut against an external surface of a swellable member when the swellable member is in an unexpanded condition and to remain in contact with the external surface after the swellable member expands.

Figure 7C:
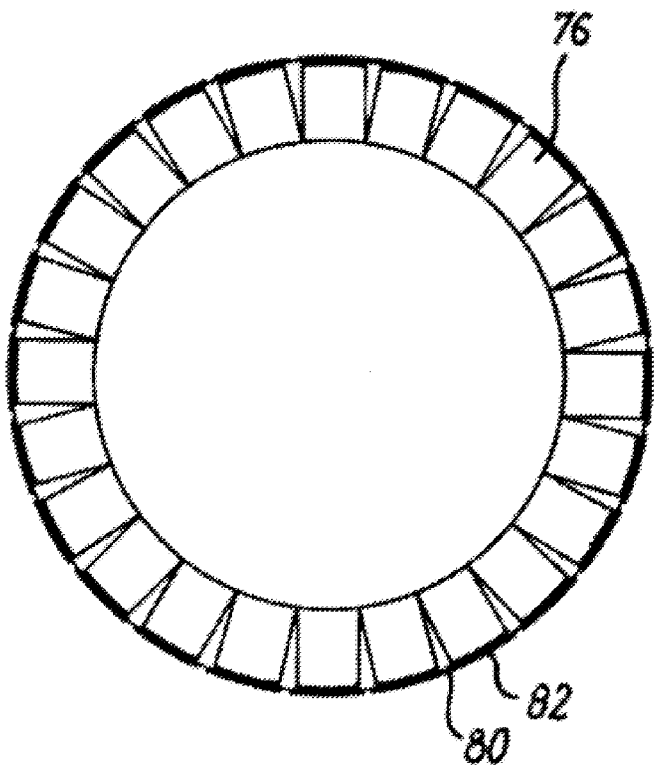
FIGS. 7A, 7B, and 7C are, respectively, perspective, part-sectional, and end views of the support structure of FIGS. 6A, and 6B in an expanded condition.
Figure 7B:
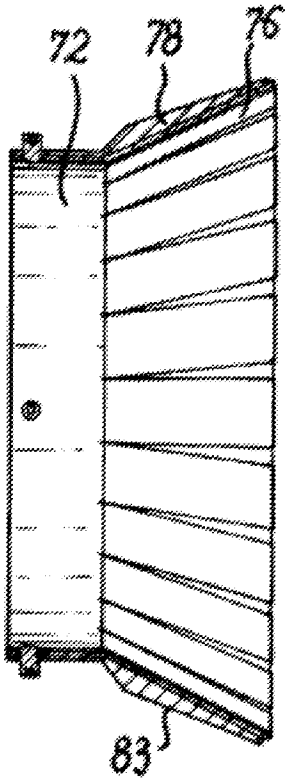
Figure 7A:
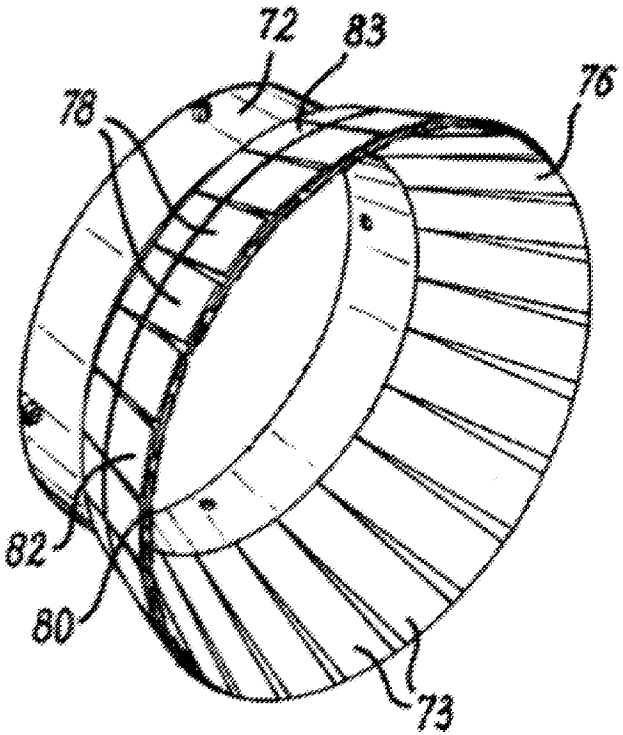

FIGS. 7A, 7B and 7C show respectively in perspective, part-sectional, and end views the support structure 70 in an expanded condition. The leaves 78 have been allowed to pivot radially outwardly about their connections with the cylindrical portion 72, such that they define a frusto-conical portion 84. The overlapping arrangement of the leaves in the inner layer 80 and outer layer 82 ensures that there is no direct path through the expanding portion 76 from the inner volume defined by the support structure to the outer surface.

Figure 8:
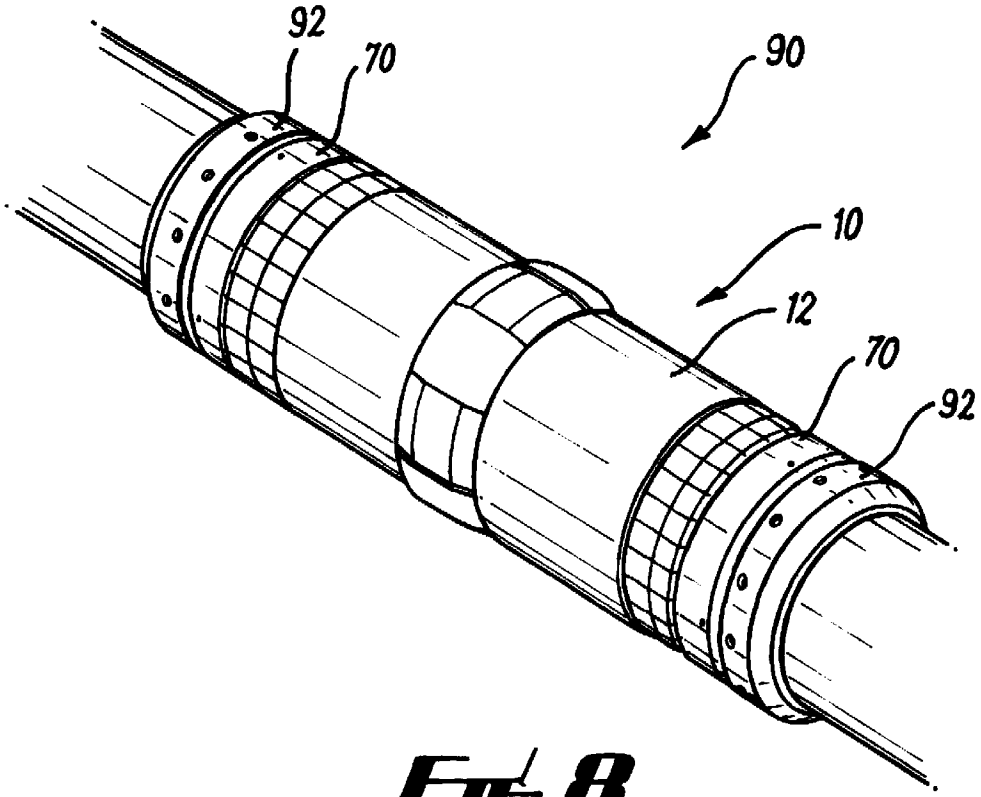
FIG. 8 is a perspective view of an apparatus and support structure in accordance with an embodiment of the invention.
Figure 9A:
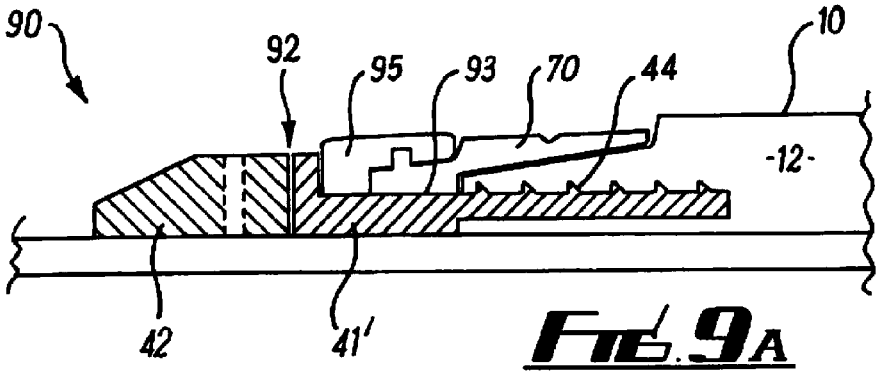
FIGS. 9A to 9C are details of longitudinal sections through assembly of FIG. 8 in, respectively, unexpanded, partially expanded, and fully expended conditions.

FIGS. 8 and 9A show the support structure 70 in use in an assembly, generally depicted at 90, with the apparatus 10 of FIGS. 1A to 3. The support structure 70 is located on end connector 92, which is similar to that shown in FIG. 4, with like parts bearing the same reference numerals. The end connector 92 differs in that the mating portion 41' comprises an extended cylindrical surface 93 on which the support structure 70 is mounted. In addition, the axial length of the enlarged bore of the mating portion 41' is adapted to take account of its extended length. Retaining ring 95 is provided over the cylindrical portion 72 of the support structure 70.

The cylindrical portion 72 of the support structure 70 is secured to the end connector 92, and the expanding portion 76 is arranged to partially surround the swellable member 12. The swellable member 12 is profiled to accommodate the expanding portion 76, and such that the outer profile of the support structure 70 is flush or recessed with respect to the maximum outer diameter of the swellable member 12.

Figure 9B:
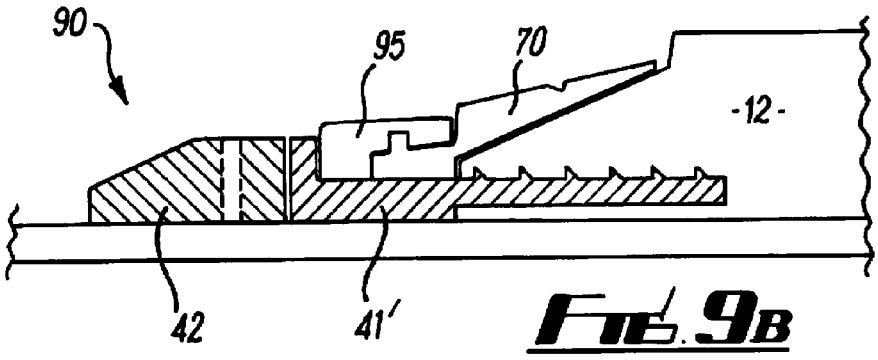

FIG. 9B shows the support structure 70 and swellable member 12 in an expanded condition. The support structure 70 is deployed to its expanded condition by expansion of the swellable member after exposure to wellbore fluids. The expanded portion 76 forms a frusto-conical portion 84 around an end of the swellable member 12.

Figure 9C:
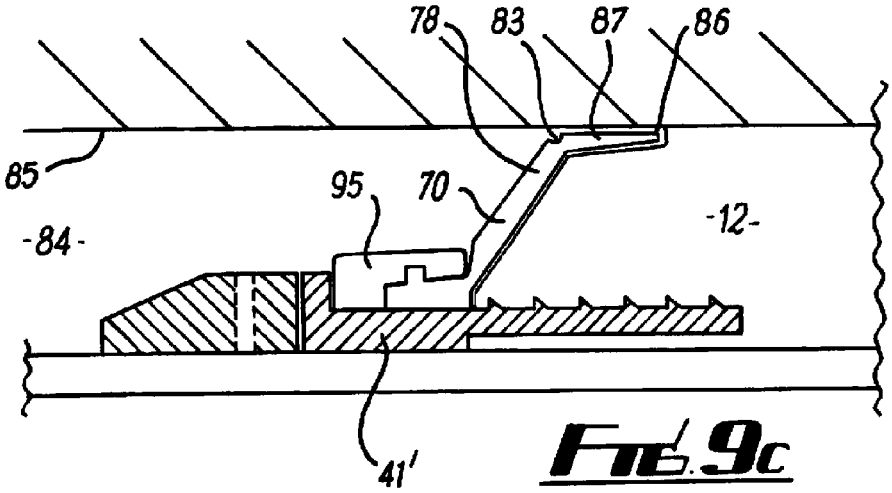

FIG. 9C shows the assembly 90 in an expanded condition where the support structure 70 is fully expanded against the inner wall 85 of a bore 84 in which the assembly is located. The ends 86 of the leaves 78 have been expanded into contact with the wall 85. Continued expansion or extrusion of the swellable member 12 tends to cause the leaves 78 to deform or fold about the line of the groove 83. The distal portions 87 of the leaves are then brought into contact with the wall 85, providing a support to the swellable member of high integrity.

The support structure 70 functions to moderate the effect of shear forces on the swellable member that would, were it not for the support structure 70, be exerted in an uncontrolled manner on the swellable member.

Figure 10:
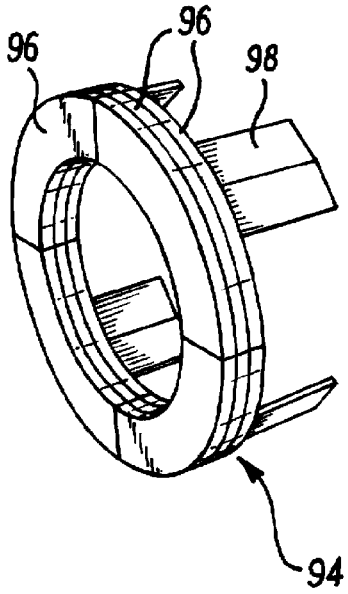
FIGS. 10 and 11 are perspective views of an alternative support structure in unexpanded and expanded conditions, respectively.
Figure 11:
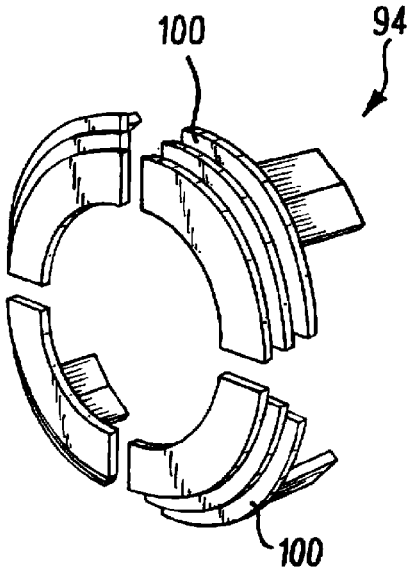

With reference now to FIGS. 10 and 11, there is shown, generally depicted at 94, a support structure in accordance with an alternative embodiment of the invention. FIG. 10 shows the support structure 94 in an unexpanded condition, and FIG. 11 shows the apparatus 94 in an expanded condition. The support structure 94 is also configured to abut against an external surface of a swellable member and a retaining portion 42 of an end connector.

Figure 12:
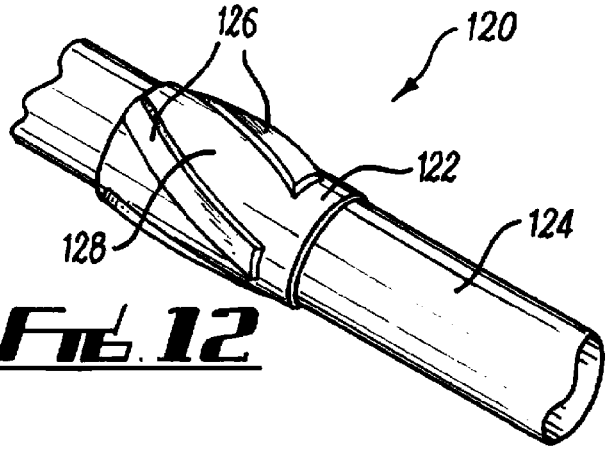
FIG. 12 is a perspective view of a centraliser in accordance with a further embodiment of the invention.

Referring now to FIG. 12, there is shown a centraliser, generally depicted at 120, in accordance with a further aspect and embodiment of the invention. The centraliser 120 consists of a substantially tubular body 122 having a throughbore sized to fit on a tubular 124. The centraliser 120 comprises a plurality of helical blades 126 upstanding from the tubular body 122. Between adjacent blades are defined flow channels 128 for fluid passing the centraliser, such as circulating mud or cement. The blades provide stand off and allow the tool to perform its centralising function. The blades and corresponding channels are designed to create a turbulent flow in the fluid, assisting in a sweep of drill cuttings and/or an appropriate distribution of cement during a cementing operation.

The maximum outer diameter of the blades 126 is selected to be a close fit with the inner diameter of the bore in which the centraliser is run. The centraliser is formed from a swellable material which is designed to expand on exposure to a hydrocarbon fluid. In this embodiment, the centraliser is formed from a solid block of a material comprising ethylene propylene diene monomer rubber (EPDM), into which channels are machined to create an arrangement of blades 126 and channels 128. In alternative embodiments, the centraliser may be formed from a combination of materials. For example, in one embodiment only the blades or a portion of the blades is formed from EPDM.

In a cementing application, the centraliser 120 provides stand off and protection for a tubular that is being run into the wellbore. When the wellbore is in the required location, the centraliser creates turbulent flow of fluid during the sweeping of drill cuttings up through the annular space. The centraliser also creates a turbulent flow of cement and sufficient stand off of the tubular such that a good cement job is provided between the tubular on which the centraliser is located and the outer tubular. This assists in providing a good seal in the annular space to prevent the flow of hydrocarbons in the annulus. However, should channelling occur along portions of the tubular between centraliser locations, or between the outer surface of the centraliser blades and the bore, the centraliser will be exposed to hydrocarbons. The centraliser will expand outwardly into sealing contact with the bore. This will seal the micro-channels and re-establish the integrity of the cement job, preventing further flow of hydrocarbons. It will be appreciated that the apparatus 10 in FIGS. 1 and 2 could be provided with formations to create a turbulent flow, such as upstanding blades or intervening channels. It will also be appreciated that the centraliser 120 could be provided with a rigid support assembly such as that shown in FIG. 1.

Figure 13:
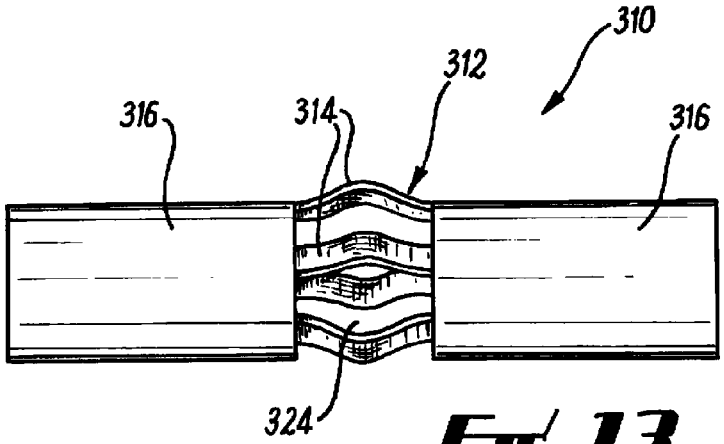
FIG. 13 is a side view of an apparatus in accordance with an alternative embodiment of the invention.
Figure 14:
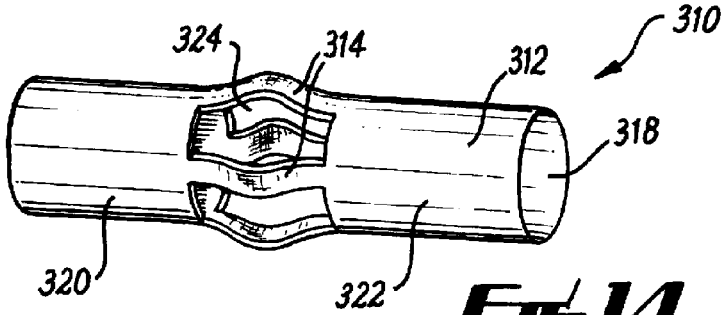
FIG. 14 is a side-perspective view of a component of the embodiment of FIG. 13.
Figure 15:
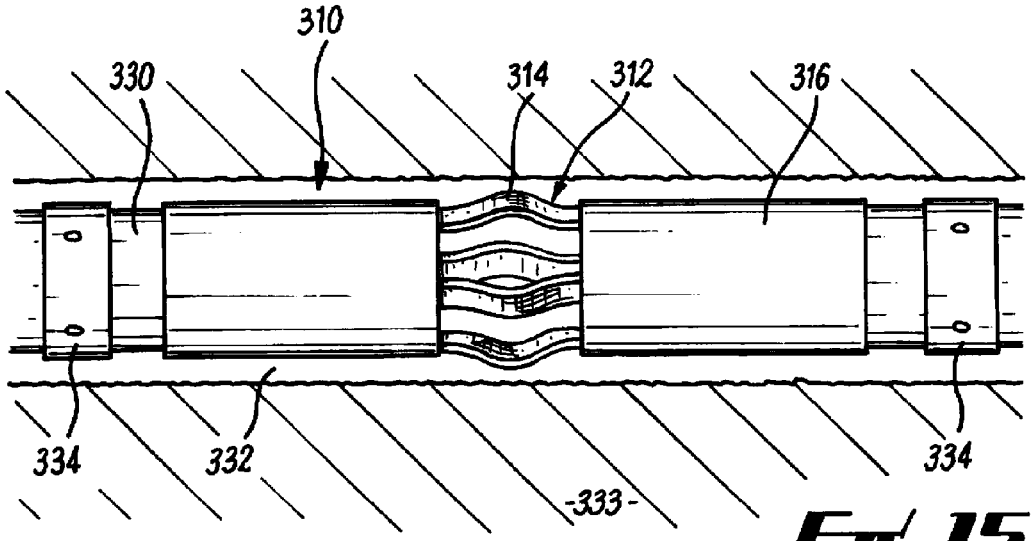
FIG. 15 is a schematic view of the apparatus of FIG. 13 in situ in a downhole environment.

FIGS. 13 to 15 illustrate a further embodiment of the invention, generally depicted at 310, consisting of a rigid assembly in the form of a body 312, formations upstanding from the body in the form of fingers or bows 314, and two swellable members in the form of sheaths 316. As most clearly shown in FIG. 14, the body 312 is substantially cylindrical and defines a throughbore 318. The body 312 consists of a first portion or collar 322 and a second portion or collar 322 both of which are cylindrical and are separated in a longitudinal direction of the body 312. The fingers 314 form joining portions for the first and second portions 320, 322 and have a maximum outer and inner diameter at a cross-section located between the first and second portions 320, 322. The fingers have an arcuate profile, and are configured to provide stand-off protection to the tubular in use, and to flex or deform on exposure to a radial or axial load. Between the fingers 314 are apertures 324 located in the body.

FIG. 15 shows the apparatus 310 in use on a tubular 330 located in a wellbore 332 in a formation 333. The apparatus 310 is slipped onto the tubular 30 such that the tubular extends through the bore 318. The apparatus 310 forms a clearance fit with the tubular 330 such that it easily slips on to the tubular 330 to its desired location and is free to rotate on the tubular. Located on the tubular and axial locations separated from the ends of the apparatus 310 are stop collars 334. Stop collars 334 are secured to the tubular 330, and restrict axial movement of the apparatus tubular in use.

The body 312 is a rigid assembly which provides stand off to the apparatus and the tubular during run-in, to allow the apparatus to perform a centralising function. The body 312 also provides rigidity and structure to the apparatus 10, allowing it to be assembled on the tubular simply by slipping the apparatus over an end of the tubular at surface and into its desired location. The rigidity and structure provided by the body 312, also allows the apparatus to rotate on the tubular during run-in, which assists in reducing friction and wear to the tubular being run.

The embodiment of FIGS. 13 to 15 is configured in particular for use in cementing applications. It is similar to the embodiment of FIG. 1 but the swellable member does not extend over the complete length of the apparatus, but rather is provided in the form of two sheaths 316 axially separated on the body. In this embodiment, no swellable material extends beneath the fingers 314, although in alternative arrangements the space beneath the fingers 314 may comprise a swellable material, in a manner similar to that shown in the in FIG. 1A.

Figure 16:
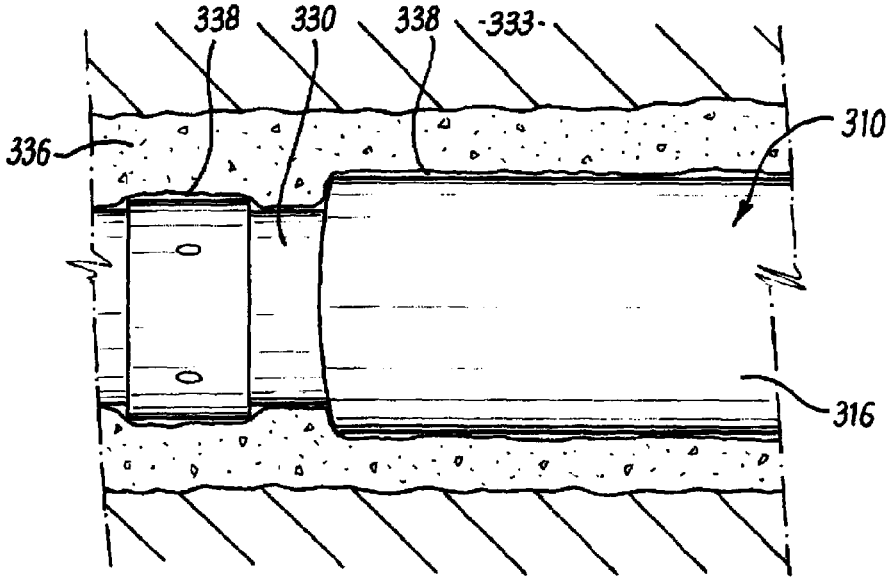
FIG. 16 is a schematic view of the apparatus of FIG. 13 after a cementing operation.
Figure 17:
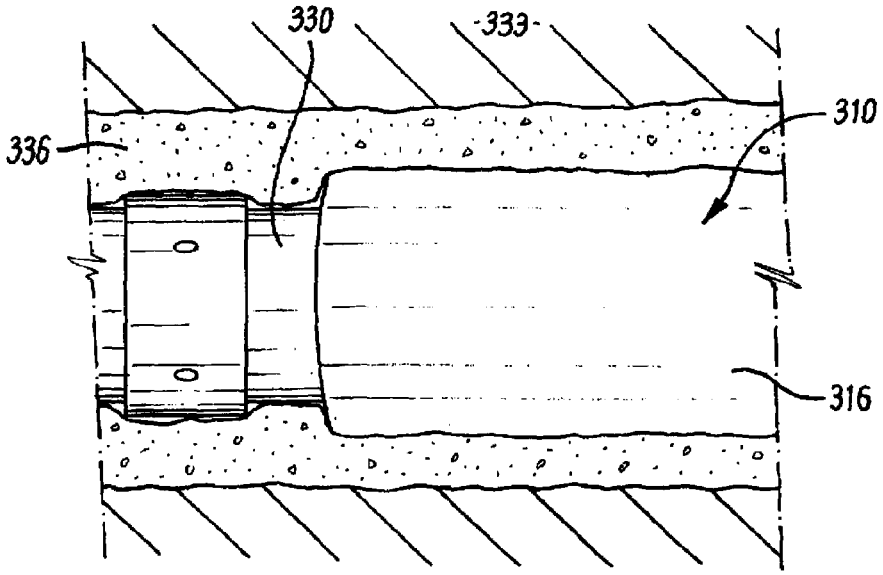
FIG. 17 is a schematic view of the apparatus of FIG. 13 after expansion.

With the apparatus 310 in the position shown in FIG. 15, cement is pumped into the annular space between the tubular and the borehole wall. The arrangement of fingers 314 and apertures 324 in the apparatus provides a large fluid bypass area for the cement. FIGS. 16 and 17 a show the apparatus of FIGS. 13 to 15 in situ in a downhole environment, subsequent to a cementing operation. The cement 336 substantially fills the annular space, but as shown in FIG. 16, the cement may form an imperfect bond with the tubular 330 and the apparatus 310. The Figure shows, exaggerated for reasons of clarity, a micro-annulus 338 formed around the tubular 330 and apparatus 310. The presence of a micro-annulus or other micro channel results in poor isolation of well fluids, and provides a possible path for well fluids to the surface. However, exposure of the swellable member 316 to well fluids will cause the swellable member to expand into contact with the cement 336 as shown in FIG. 17. This provides an effective seal at the location of the apparatus 310, and improves the integrity of the cement job.

In an alternative embodiment of the invention (not illustrated), the body 312 is provided with one or more formations raised from the body and separated axially from the fingers 314. These formations are formed to an outer diameter less than that of the fingers, and provide secondary stand-off by defining an outer surface which supports the apparatus in circumstances where the fingers have flexed to such an extent that the outer diameter is significantly reduced. In another variation to the described embodiments, the apparatus may be configured for use on an expandable tubular. The rigid assembly is capable of expanding on the tubular, and the swellable member is brought into proximity or contact to a wall, lining or casing of a bore in which the apparatus is located. Subsequent exposure to wellbore fluid effects a seal in the bore and/or further centralisation of the apparatus. In a further alternative embodiment (not illustrated), the apparatus is a logging tool, and the rigid assembly or support assembly of the apparatus is used to provide protection to an instrument or sensor of the logging tool. The instrument or sensor may be embedded in a swellable member in a location which is protected by the assembly.

The present invention provides improved centralisation of downhole apparatus in a variety of downhole applications. In one of these aspects, the invention provides an improved centraliser for assisting in providing isolation in a wellbore. Variations and modifications to the above described embodiments may be made within the scope of the invention herein intended.

What is claimed is:

1. A centraliser for a downhole tubular, the centraliser comprising:

a body;

a plurality of formations upstanding from the body and circumferentially spaced apart around the body; and a swellable member, comprising a swellable material selected to expand on exposure to at least one predetermined fluid, disposed on an outer surface of the body and between the plurality of formations and the tubular.

2. The centraliser as claimed in claim 1, wherein the swellable material is selected to expand on exposure to a hydrocarbon fluid.

3. The centraliser as claimed in claim 1, wherein the body comprises:

two collars spaced apart from each other in a longitudinal direction along the centraliser; and wherein the plurality of formations comprise a plurality of spaced-apart fingers extending in a longitudinal direction along the centraliser, wherein the plurality of spaced-apart fingers are spaced circumferentially around the centraliser.

4. The centraliser as claimed in claim 3, wherein at least one collar and the plurality of fingers are of unitary construction.

5. The centraliser as claimed in claim 3, wherein the plurality of spaced-apart fingers are configured to flex or deform under an axial or radial load.

6. The centraliser as claimed in claim 1, wherein the centraliser is configured to rotate with respect to a downhole tubular on which the centraliser is mounted in a downhole environment.

7. The centraliser as claimed in claim 1, wherein the swellable member is configured to expand to an inner diameter of a wellbore in which the centraliser is located.

8. The centraliser as claimed in claim 1, wherein the swellable member is configured to expand to form a seal with cement in a wellbore in which the centraliser is located.

* * * * *